US005094556A

United States Patent [19]

Kohler

[11] Patent Number: 5,094,556

[45] Date of Patent: Mar. 10, 1992

[54] BATTERY TERMINAL CLEANING APPARATUS

[76] Inventor: Kenneth F. Kohler, 4207 Green Point, Waco, Tex. 76710

[21] Appl. No.: 699,647

[22] Filed: May 14, 1991

[51] Int. Cl.[5] ..... A46B 11/00

[52] U.S. Cl. ..... 401/9; 15/106; 401/11; 401/34; 401/36; 401/39; 401/268; 401/269; 401/281

[58] Field of Search ..... 401/268, 9, 281, 10, 401/269, 11, 34, 36, 37, 39; 15/106

[56] References Cited

U.S. PATENT DOCUMENTS

| | | | |
|---|---|---|---|
| 371,589 | 10/1887 | Kienardt | 401/37 |
| 1,950,862 | 3/1934 | Page | 15/106 |
| 2,908,923 | 10/1959 | Schlechter | 401/10 |
| 4,575,892 | 3/1986 | Ross | 15/106 |

FOREIGN PATENT DOCUMENTS

| | | | |
|---|---|---|---|
| 361572 | 10/1922 | Fed. Rep. of Germany | 401/36 |
| 1100275 | 3/1955 | France | 401/34 |

*Primary Examiner*—Steven A. Bratlie
*Attorney, Agent, or Firm*—Leon Gilden

[57] ABSTRACT

An apparatus wherein an elongate cylindrical housing mounts a first and second cylindrical cap respectively at opposed terminal ends of the housing. The housing includes as matrix of wire brushes orthogonally mounted to each end of the housing, with a first end including a projection for positioning within a side mount terminal battery, with the second end providing a cylindrical cavity for receiving a terminal for securement to the associated side mount battery. A modification of the invention includes a central reservoir receiving a cleaning solution that is selectively directed through each terminal end of the housing for enhanced cleaning of the associated battery and connector.

6 Claims, 4 Drawing Sheets

BATTERY TERMINAL CLEANING APPARATUS

BACKGROUND OF THE INVENTION

1. Field of the Invention

The field of invention relates to battery cleaning apparatus, and more particularly pertains to a new and improved battery terminal cleaning apparatus wherein the same is arranged for selective cleaning of a side mounted battery terminal and associated battery cable terminal.

2. Description of the Prior Art

Various devices have been utilized in the prior art for the cleaning of battery terminals. The advent of side mount terminals, however, have presented a new set of parameters for cleaning of such terminals requiring projections and recesses for the cleaning of battery terminals and cables. Examples of the prior art include U.S. Pat. No. 4,575,892 to Ross wherein a device includes a first brush mounted in a projecting manner relative to a housing, with a second brush mounted in a cavity relative to the same housing.

U.S. Pat. No. 4,238,867 to Ruggero, et al. sets forth a tube abrading tool, wherein a first abrading tool is formed as a cylinder and a second abrading tool is formed with a cavity mounted to opposed ends of a rotatably motor.

U.S. Pat. No. 4,255,828 sets forth a battery terminal device arranged for securement to a lower terminal end of a socket wrench.

As such, it may be appreciated that there continues to be a need for a new and improved battery terminal cleaning apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of battery cleaning apparatus now present in the prior art, the present invention provides a battery terminal cleaning apparatus wherein the same is arranged for the cleaning of side mounted battery terminals and associated cable connections. As such, the general purpose of the present invention, which will be described subsequently in greater detail, is to provide a new and improved battery terminal cleaning apparatus which has all the advantages of the prior art battery cleaning apparatus and none of the disadvantages.

To attain this, the present invention provides an apparatus wherein an elongate cylindrical housing mounts a first and second cylindrical cap respectively at opposed terminal ends of the housing. The housing includes a matrix of wire brushes orthogonally mounted to each end of the housing, with a first end including a projection for positioning within a side mount terminal battery, with the second end providing a cylindrical cavity for receiving a terminal for securement to the associated side mount battery. A modification of the invention includes a central reservoir receiving a cleaning solution that is selectively directed through each terminal end of the housing for enhanced cleaning of the associated battery and connector.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved battery terminal cleaning apparatus which has all the advantages of the prior art battery cleaning apparatus and none of the disadvantages.

It is another object of the present invention to provide a new and improved battery terminal cleaning apparatus which may be easily and efficiently manufactured and marketed.

It is a further object of the present invention to provide a new and improved battery terminal cleaning apparatus which is of a durable and reliable construction.

An even further object of the present invention is to provide a new and improved battery terminal cleaning apparatus which is susceptible of a low cost of manufacture with regard to both materials and labor, and which accordingly is then susceptible of low prices of sale to the consuming public, thereby making such battery terminal cleaning apparatus economically available to the buying public.

Still yet another object of the present invention is to provide a new and improved battery terminal cleaning apparatus which provides in the apparatuses and methods of the prior art some of the advantages thereof, while simultaneously overcoming some of the disadvantages normally associated therewith.

Still another object of the present invention is to provide a new and improved battery terminal cleaning apparatus wherein the same provides a central reservoir utilizing a cleaning solution permitting the cleaning solution to be selectively directed to opposed ends of the associated housing to effect enhanced cleaning of a battery terminal and associated connector cable terminal end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
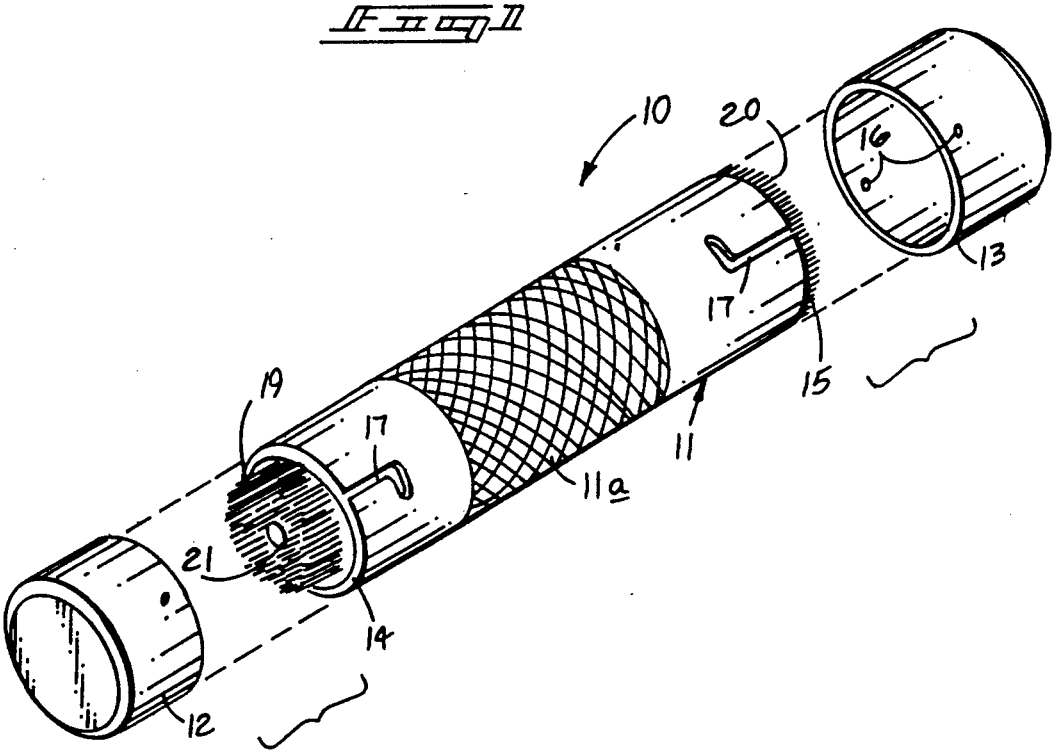
FIG. 1 is an isometric illustration of the instant invention.
Figure 2:
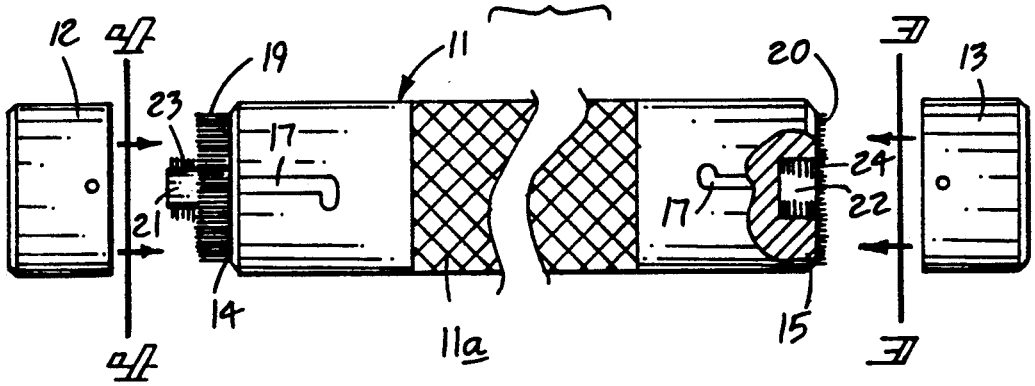
FIG. 2 is an orthographic side view of the instant invention.
Figure 4:
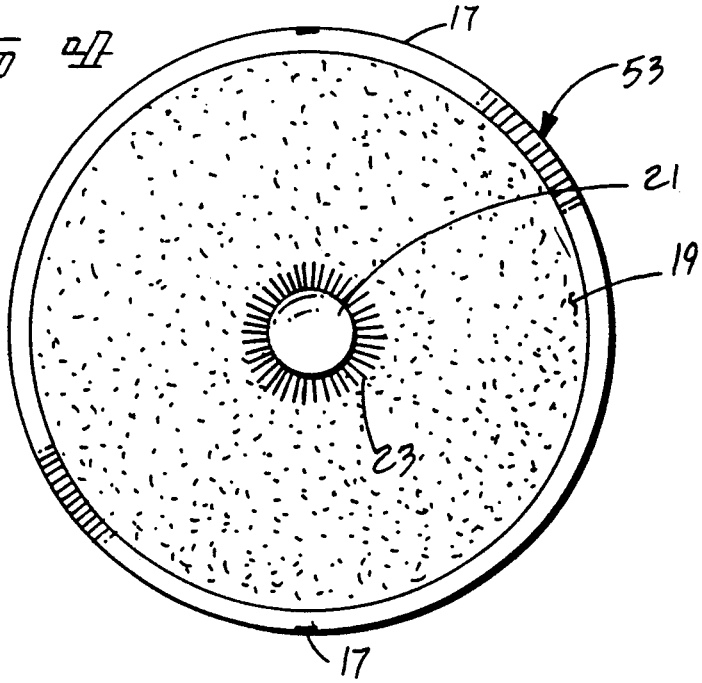
FIG. 4 is an orthographic view, taken along the lines 4—4 of FIG. 2 in the direction indicated by the arrows.
Figure 3:
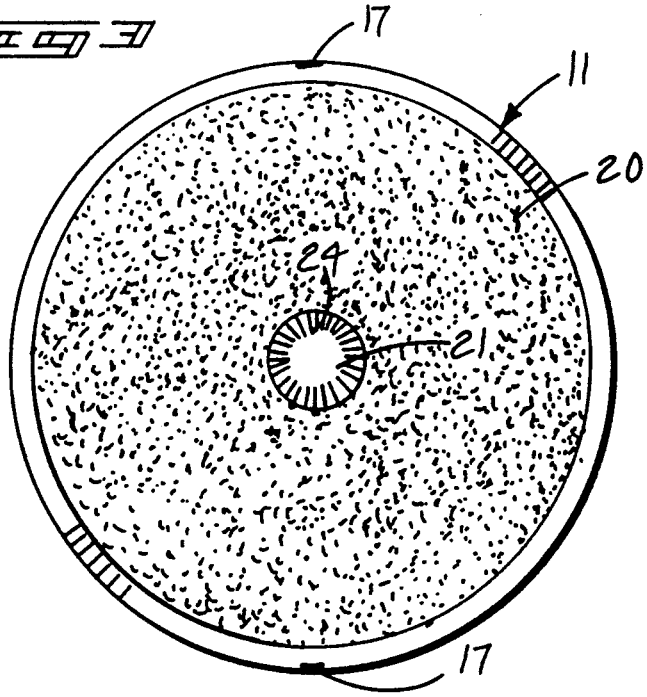
FIG. 3 is an orthographic view, taken along the lines 3—3 of FIG. 2 in the direction indicated by the arrows.

With reference now to the drawings, and in particular to FIGS. 1 to 7 thereof, a new and improved battery terminal cleaning apparatus embodying the principles and concepts of the present invention and generally designated by the reference numerals 10 and 10*a* will be described.

More specifically, the battery terminal cleaning apparatus 10 of the instant invention essentially comprises a cylindrical central housing 11 defined by a single axis, including a knurled central cylindrical area 11*a*. The housing 11 includes a first cylindrical cap 12 and a second cylindrical cap 13 securable in a removable manner relative to a housing first terminal end wall 14 and a housing second terminal end wall 15, each orthogonally oriented relative to the single axis, as noted above. Each cylindrical cap 12 and 13 includes diametrically opposed pins 16 projecting interiorly of each cap and received within a plurality of "L" shaped grooves 17 that orthogonally intersect each end wall 14 and 15. The "L" shaped grooves 17 are diametrically opposed relative to one another to receive the pins 16 of each end cap for securement of each cap relative to each end wall of the housing 11. A cylindrical first wire bristle brush matrix 19 is mounted orthogonally relative to the first end wall 14, with a cylindrical second bristle brush matrix 20 mounted orthogonally relative to the second cylindrical cap 13, with each brush matrix projecting exteriorly of each end wall, with each of the bristles arranged generally parallel relative to the single axis. The first terminal end wall 14 includes a cylindrical projection 21 that is coaxially aligned with the housing 11 extending beyond the first terminal end wall 14 and the bristle brush matrix 19. The cylindrical cavity 22 is coaxially aligned with the projection 21 and the housing, and is recessed below the housing second terminal end wall 15. The cylindrical projection 21 is arranged for projection within an associated side mounted battery terminal, whereas the single cavity 22 receives the securement fastener conventionally provided in a battery terminal, as typically utilized in an automotive environment. The cylindrical projection 21 includes a cylindrical projection brush matrix 23, wherein the brush matrix extends outwardly of the cylindrical side wall of the cylindrical projection, wherein the cylindrical cavity 22 includes a cylindrical cavity brush matrix 24, wherein each bristle extends radially relative to the cylindrical cavity 24 as the bristles of the cylindrical projection brush matrix 23 extend radially relative to the projection 21, as illustrated.

Figure 5:
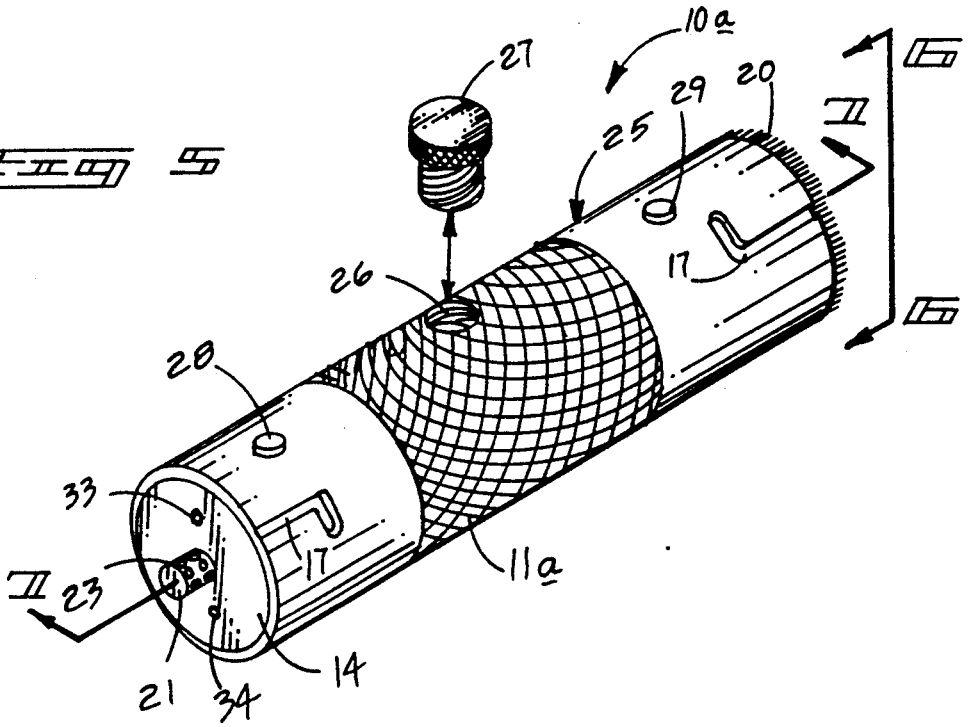
FIG. 5 is an isometric illustration of a modified aspect of the instant invention.
Figure 6:
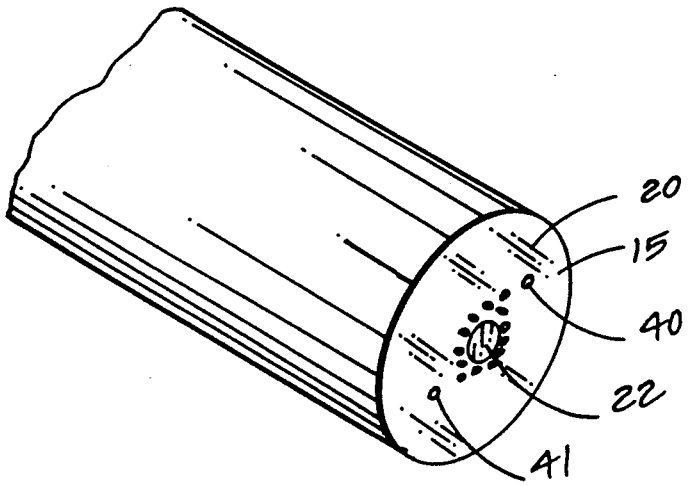
FIG. 6 is an isometric end view of the modified structure of the instant invention, taken along the lines 6—6 of FIG. 5 in the direction indicated by the arrows.
Figure 7:
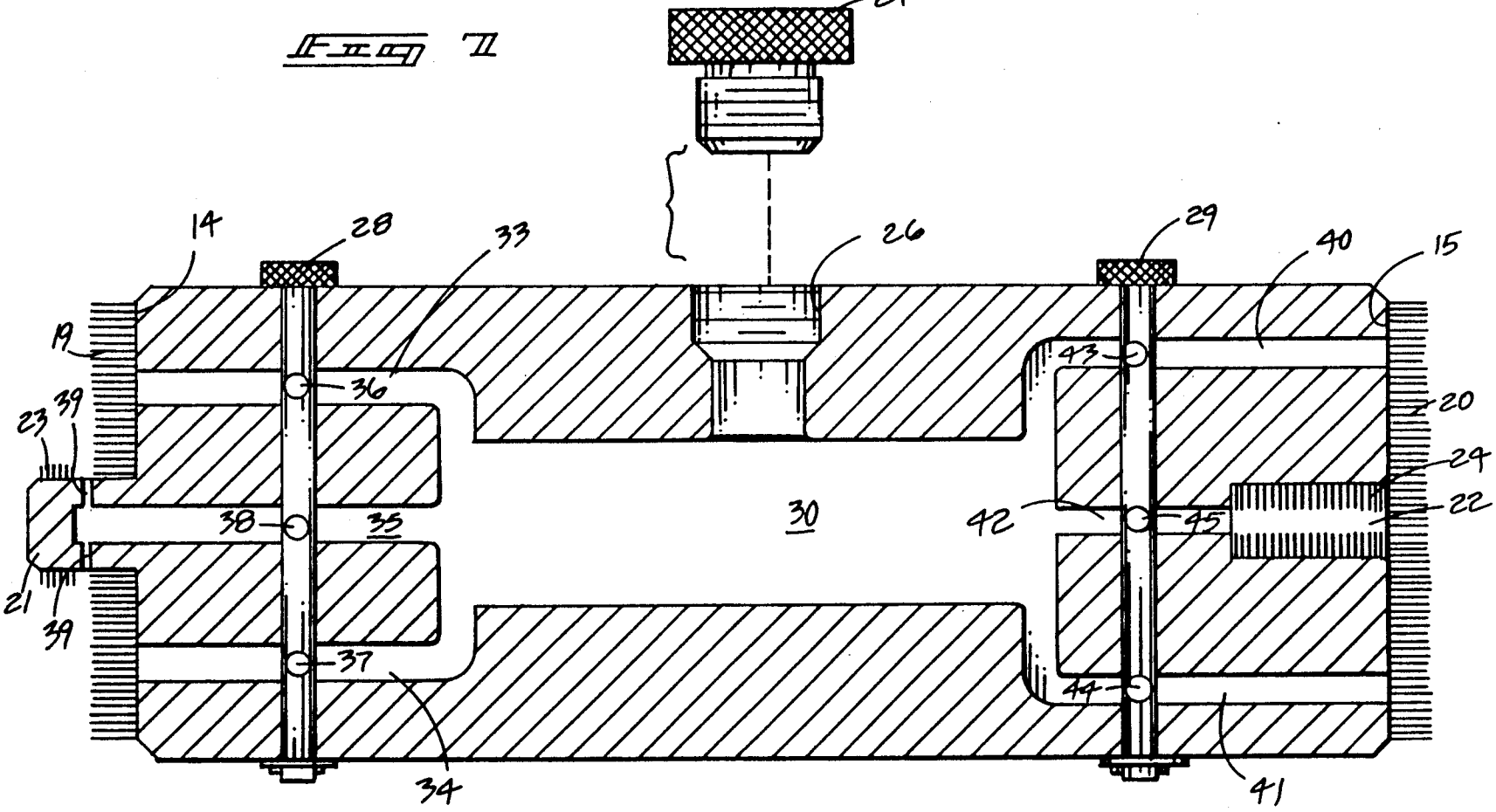
FIG. 7 is an orthographic cross-sectional illustration, taken along the lines 7—7 of FIG. 5 in the direction indicated by the arrows.

FIGS. 5-7 illustrate the use of a modified cylindrical body 25 that includes an internally threaded fill bore 26 radially projecting into the housing 11 medially of the single axis of the housing, wherein an externally threaded fill plug 27 is selectively securable relative to the fill bore 26. The fill bore 26 is in fluid communication with a coaxially aligned reservoir 32 that is coaxially aligned relative to the cylindrical housing 11. A reservoir 30 is in fluid communication with each of the first and second terminal end walls 14 and 15. A respective first and second conduit 33 and 34 are in fluid communication with the reservoir 30 and are directed from the reservoir 30 orthogonally in diametrically opposed positions through the first terminal end wall 14. A third conduit 35 is coaxially aligned with the housing in the cylindrical body 25 and is directed into the projection 21. The third conduit 35 includes a plurality of cylindrical projection conduits 39 that are diametrically directed through the projection 21 to feed a cleaning solution contained within the reservoir 30 into the bristle brush matrix 19 and the cylindrical projection brush matrix 23 to enhance cleaning of corrosion and the like developed within a battery terminal. A first rotatable valve 28 includes a cylindrical valve body, with a respective first and second valve bore 36 and 37 directed therethrough permitting fluid closure of the first and second conduits 33 and 34, wherein a third first valve bore 38 permits selective closure of the third conduit 35. The first through third first valve bores 36-38 are arranged parallel relative to one another and coextensive therewith, whereupon ninety degree rotation of the valve 28 permits selective fluid flow or closure through each of the conduits 33-35. In a like manner, a second valve 29 formed with a second valve cylindrical body includes respective first, second, and third second valve bores 43, 44, and 45 effecting selective fluid flow in a like manner as the first valve through respective fourth, fifth, and sixth conduits 40, 41, and 42 respectively. The fourth and fifth conduits 40 and 41 effect selective fluid flow into the second bristle brush matrix 20 and are positioned in diametrically opposed positions relative to the single axis of the housing, wherein the sixth conduit 42 permits fluid flow into the cylindrical cavity 22 and the associated cylindrical cavity brush matrix 24 contained therewithin providing enhanced cleaning of a battery terminal cable end of conventional construction formed with a planar surface for cleaning by the second bristle brush matrix 20 and the cylindrical cavity 22 respectively.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A battery terminal cleaning apparatus, comprising in combination, a cylindrical central housing, the cylindrical central housing including a first terminal end wall spaced from and parallel a second terminal end wall, the cylindrical central housing including a single axis, with the first and second terminal end wall orthogonally oriented relative to the single axis, and a first cylindrical cap selectively securable to the cylindrical central housing about the first terminal end wall, and a second cylindrical cap selectively securable to the cylindrical central housing about the second terminal end wall, and a cylindrical first, wire bristle brush matrix fixedly mounted to and orthogonally projecting from the first terminal end wall, and a cylindrical second bristle brush matrix orthogonally mounted to and projecting exteriorly of the second terminal end wall, and a cylindrical projection coaxially and fixedly mounted to the first terminal end wall, and a cylindrical cavity coaxially aligned relative to the cylindrical projection and recessed below the second terminal end wall.

2. An apparatus as set forth in claim 1 wherein the cylindrical projection includes a cylindrical projection brush matrix defined by first bristles, wherein the first bristles are radially mounted relative to the cylindrical projection, and a cylindrical cavity brush matrix mounted within the cylindrical cavity defined by second bristles, wherein each second bristle is radially oriented within the cylindrical cavity.

3. An apparatus as set forth in claim 2 wherein the first cylindrical cap and the second cylindrical cap each include a plurality of diametrically opposed pins projecting interiorly of the respective first and second cylindrical cap, and the cylindrical central housing includes a plurality of diametrically opposed "L" shaped grooves, wherein each "L" shaped groove of each plurality of "L" shaped grooves is orthogonally intersecting with each terminal end wall.

4. An apparatus as set forth in claim 3 wherein the cylindrical central housing includes a central reservoir, the central reservoir coaxially aligned within the cylindrical central housing, and a fill bore radially projecting through the cylindrical central housing in fluid communication with the reservoir, and a plug member selectively securable to the fill bore, and the reservoir including a cleaning solution contained therewithin, and first fluid communication means in fluid communication with the reservoir and the first terminal end wall, and second fluid communication means in fluid communication with the reservoir and the second terminal end wall.

5. An apparatus as set forth in claim 4 wherein the first fluid communication means includes a first conduit and a second conduit, wherein the first conduit and the second conduit are arranged generally parallel to one another and are positioned in diametrically opposed positions relative to the cylindrical projection in fluid communication with the first terminal end wall and the cylindrical first wire bristle brush matrix, and a third conduit in fluid communication between the reservoir and projecting into the cylindrical projection, and wherein the third conduit includes a plurality of cylindrical projection conduits orthogonally oriented relative to the third conduit and in diametrically opposed relationship relative to one another extending into the cylindrical projection brush matrix, and with a first rotatable valve, and the first rotatable valve including a first rotatable valve cylindrical body, wherein the cylindrical body is orthogonally intersecting the first, second, and third conduits, and the first valve including a first bore, a second bore, and a third bore, wherein each bore is arranged parallel and coextensive relative to one another and positioned within each respective first, second, and third conduit, whereupon selective rotation of the first valve effects selective simultaneous fluid flow through the first, second, and third conduit.

6. An apparatus as set forth in claim 5 wherein the second fluid communication means includes a fourth conduit and a fifth conduit, the fourth and fifth conduits each arranged parallel relative to one another and in fluid communication with the reservoir and projecting orthogonally into the second terminal end wall for directing the cleaning solution to the cylindrical second bristle brush matrix, and a sixth conduit in fluid communication with the reservoir and coaxially intersecting the cylindrical cavity for directing the cleaning solution to the cylindrical cavity and the cylindrical cavity brush matrix, and a second valve orthogonally intersecting the fourth, fifth, and sixth conduits, with the second valve including a second valve first bore, a second valve second bore, and a second valve third bore, wherein each of the second valve first, second, and third bores are arranged parallel and coextensive relative to one another and diametrically directed through the second valve cylindrical body, and each respective second valve first bore, second valve second bore, and second valve third bore is positioned within the respective fourth, fifth, and sixth conduits.

* * * * *